US006935227B2

(12) United States Patent
Lopez et al.

(10) Patent No.: US 6,935,227 B2
(45) Date of Patent: Aug. 30, 2005

(54) SINGLE PIN GRIPPER ASSEMBLY FOR STRAPPING MACHINE HEAD

(75) Inventors: Jonathan Lopez, Vernon Hills, IL (US); Timothy B. Pearson, Antioch, IL (US); David B. Gerhart, Chicago, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 47 days.

(21) Appl. No.: 10/449,176

(22) Filed: May 30, 2003

(65) Prior Publication Data

US 2004/0237808 A1 Dec. 2, 2004

(51) Int. Cl.[7] ..... B65B 57/10

(52) U.S. Cl. ..... 100/4; 100/29; 100/32; 53/589

(58) Field of Search ..... 100/8, 16, 25, 100/26, 29–33 R, 33 PB, 4; 53/589

(56) References Cited

U.S. PATENT DOCUMENTS

| | | | | |
|---|---|---|---|---|
| 3,791,420 A | * | 2/1974 | Beach | 140/93.2 |
| 4,161,910 A | * | 7/1979 | Leslie et al. | 100/26 |
| 6,401,764 B1 | * | 6/2002 | Bell, Jr. | 140/93.2 |
| 6,532,722 B2 | * | 3/2003 | Gerhart et al. | 53/589 |
| 6,543,341 B2 | * | 4/2003 | Lopez | 100/4 |

FOREIGN PATENT DOCUMENTS

| | | |
|---|---|---|
| DE | 3426252 | 2/1985 |
| EP | 1170214 | 1/2002 |
| EP | 1277657 | 1/2003 |
| JP | 8337205 | 12/1996 |

* cited by examiner

*Primary Examiner*—Derris H. Banks
*Assistant Examiner*—Shelley Self
(74) *Attorney, Agent, or Firm*—Mark W. Croll, Esq.; Donald J. Breh, Esq.; Welsh & Katz, Ltd.

(57) ABSTRACT

A gripper assembly for a strapping head for a strapping machine includes a body having a generally rectangular cross-section and defining a cavity therein having an end wall. The body has a gripping pad on an exterior portion thereof. The body further includes pin openings in opposing walls. A single spring stack is disposed in the cavity. An end of the spring stack abuts the inner end wall of the body. A follower block is positioned in the cavity. The follower block has a base and a roller support portion. The roller support portion has pin openings therein. A roller is positioned in the roller support portion. The roller has a passage therethrough. A retaining pin is disposed through the body pin openings, the follower block pin openings and the roller passage. The retaining pin is disposed to maintain the follower block within the body cavity with the roller secured thereto and to maintain the spring stack captured within the body cavity.

7 Claims, 2 Drawing Sheets

SINGLE PIN GRIPPER ASSEMBLY FOR STRAPPING MACHINE HEAD

BACKGROUND OF THE INVENTION

The present invention is directed to an improved gripper assembly for a strapping machine strapping head. More particularly, the present invention is directed to a gripper assembly for use in a strapping machine head that uses a single pin and a single spring stack for effecting proper strap grip for strap tensioning and welding.

Strapping machines are in widespread use for securing straps around loads. One type of known strapper includes a strapping head and drive mechanism mounted within a frame. A chute is mounted to the frame, through which the strapping material is fed.

In a typical stationary strapper, the chute is mounted at about a work surface, and the strapping head is mounted to a horizontal or vertical portion (or perhaps an inclined portion) of the chute. The strapping or sealing head provides a number of functions. First, the strapping head includes a plurality of grippers for gripping the strap during the course of a strapping operation. The strapping head also includes a cutter to cut the strap from a strap source or supply. Last, the strapping head includes a sealer to seal an overlying course of strapping material onto itself. This seal is commonly referred to as a weld and is effected by heating overlying courses of the strap by use of a vibrating element.

In the course of the strapping operation, a first course of strapping material (e.g., the leading end of the strapping material) is conveyed from a dispenser into a feed arrangement and into the strapping head. The leading end is conveyed through the strapping head (in proximity to a first or loop gripper), through the chute, and back to the strapping head. The leading end is conveyed in the strapping head over a second or end gripper to a position within the sealing region.

The leading end is then gripped by the end gripper and the strapping material is tensioned around the load. Subsequent to tensioning, the trailing end of the strapping material is gripper by the loop gripper and the seal or weld is effected in the strap. The strap is then cut from the source or supply and is released from the strapping machine.

It is important that the grippers maintain a firm and sure grip on the strap at all "gripping" times. To this end, known strapping machines use a cam that contacts a gripper assembly to effect this grip of the strap. Known gripper assemblies include a roller (for contact with the machine camming surface) mounted to a cam follower block by a pin. A grip is rigidly mounted to a grip support which is in turn mounted to the cam follower by a second pin. A pair of side-by-side spring sets are positioned between the cam follower and the grip support to permit the grip to apply a balanced pressure to strap.

In such an arrangement, two pins are needed (one for mounting the roller to the cam follower block and a second for mounting the grip support to the cam follower block. Moreover, side-by-side sets of springs are needed to provide proper application and alignment when applying pressure to the strap (e.g., during spring compression).

While such an arrangement functions well, it does have its drawbacks. One such drawback is the complexity of the design. The need for multiple pins and multiple spring sets requires additional moving parts and components which, in mechanical systems generally is undesirable. In addition, the need for multiple pins and side-by-sides spring sets increases the overall size and thus the weight of the gripper.

Accordingly, there exists a need for a gripper assembly for a strapping machine strapping head that reduces the overall size and weight of the gripper. Desirably, such a gripper uses a reduced number of components thus resulting in a simpler, less complex gripper configuration while maintaining gripper components aligned during gripping operation.

BRIEF SUMMARY OF THE INVENTION

A gripper assembly for a strapping machine strapping head includes a body having a generally rectangular cross-section and defining a cavity therein having an end wall. The body has a gripping pad on an exterior portion thereof and includes openings on opposing walls thereof. In a preferred embodiment, the openings are slightly elongated or notched.

A single spring stack is disposed in the cavity. An end of the spring stack abuts the inner end wall of the body. A follower block is positioned in the cavity. The follower block has a base and a roller support portion. The roller support portion has openings therein that align with the body openings. A roller is positioned in the roller support portion. The roller has a passage therethrough that aligns with the body and follower block openings.

A retaining element, preferably a retaining pin, is disposed through the body openings, the follower block openings and the roller passage. The retaining pin is disposed to maintain the follower block within the body with the roller secured thereto and to maintain the spring stack captured within the body cavity.

The elongated body openings permit slight longitudinal movement of the roller and follower block relative to the body to compress and expand the spring stack.

A present gripper assembly includes two concentrically disposed springs and a single retaining pin. A strapping head having the present single pin gripper assembly is also disclosed.

Advantageously, the present gripper assembly reduces the overall size and weight of the gripper. Such a gripper uses a reduced number of components and results in a simpler, less complex gripper configuration while maintaining gripper components aligned during gripping operation.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
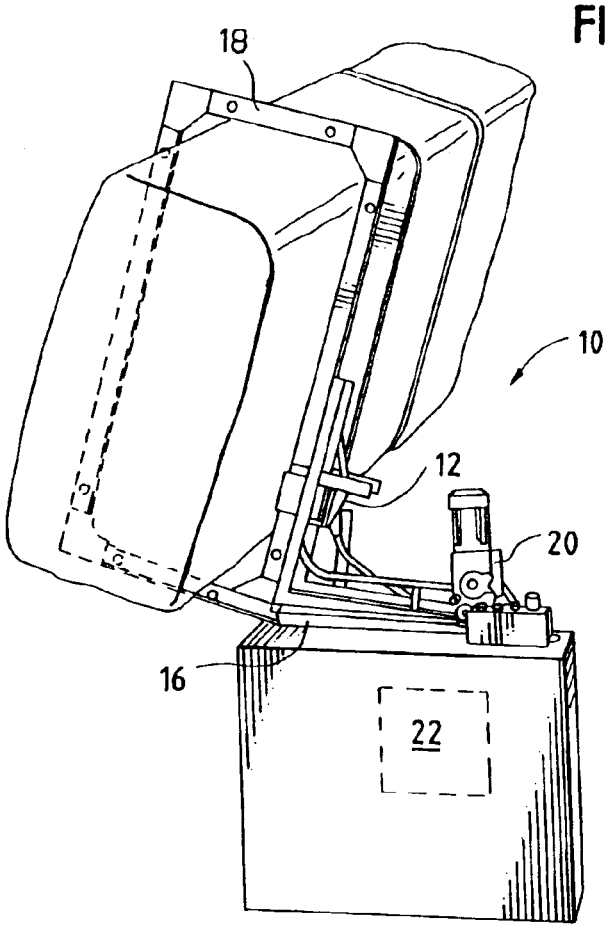
FIG. 1 is a perspective view of an exemplary strapping machine having a strapping head with single pin gripper assemblies embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the U.S. Patent Office, and does not imply, nor should be inferred to limit the subject matter disclosed herein.

Referring to the figures and in particular FIG. 1, there is shown a strapping machine 10 having a strapping head 12 having single pin gripper assemblies 14 (see FIG. 2) embodying the principles of the present invention. The strapping machine 10 includes, generally, a frame 16, a strap chute 18, a feed assembly 20 and the strapping or sealing head 12. A controller 22 provides automatic operation and control of the strapper 10.

Figure 2:
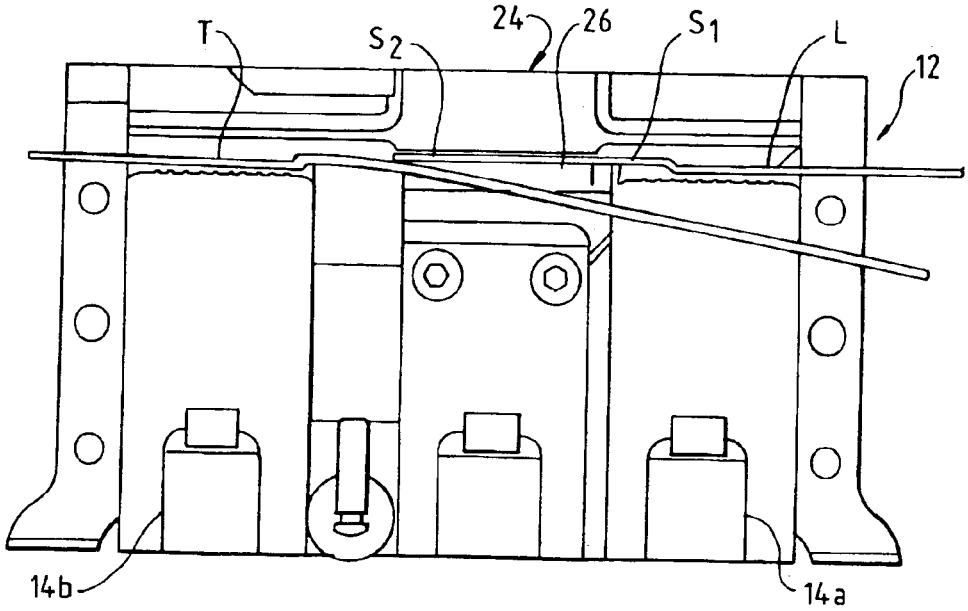
FIG. 2 is a schematic illustration of the strapping head showing the strap path through the head and the relative location of the gripper assemblies and the strap as positioned at the grips.

Referring now to FIG. 2, there is shown schematically the position of the first $S_1$ and second $S_2$ courses of strapping material as they are positioned within the strapping head 12 during the strapping operation. As illustrated, a leading end L of the strap is positioned at an end gripping assembly 14*a* (or end grip) and a trailing end T of the strap is positioned at a loop gripping assembly 14*b* (or loop grip). Both of the grips 14*a,b* are positioned within the sealing head 12 for reciprocating movement, and are shown in the open or non-gripping position. Upon a predetermined signal, the end grip 14*a* will actuate to secure the strap between the grip 14*a* and the sealing head body 24, and the strap will then be tensioned. The loop grip 14*b* will then actuate to secure the strap to the sealing head body 24 so that the strap is secured at both sides of the sealer 26 and the sealer (vibrating welder) is actuated.

Figure 3:
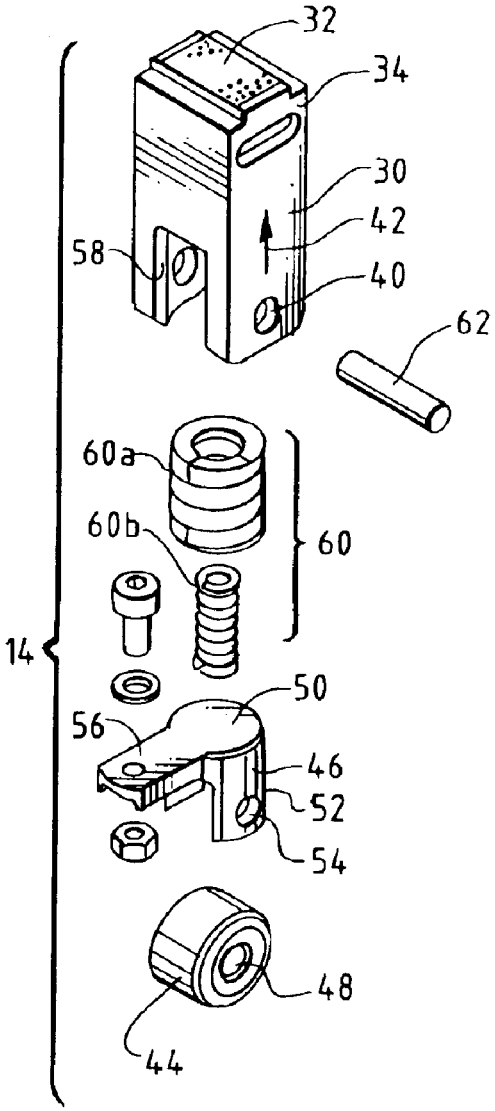
FIG. 3 is a top perspective exploded view of the gripper assembly.
Figure 4:
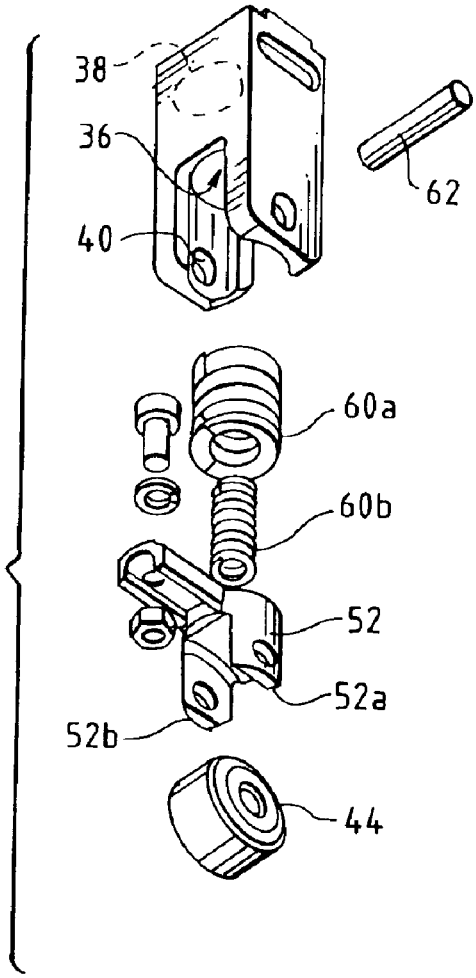
FIG. 4 is a bottom perspective exploded view of the gripper assembly.

The gripper assemblies 14 are configured to secure the strap at the sealing 12 head for tensioning and sealing. Referring to FIGS. 3 and 4, each gripper assembly 14*a,b* includes a gripper body 30 having a grip pad 32 at the end 34 thereof. The body 30 has a cavity 36 therein and an end wall 38 at the base of the cavity 36. In that the body 30 is oriented with the cavity 36 downward, the end wall 38 is positioned at the top of the (inverted) cavity 36.

The body 30 further includes a pair of pin openings 40 in opposing walls. In a present embodiment, the openings 40 are formed having a slightly elongated shape extending in a longitudinal direction, as indicated by the arrow at 42, along the body 30.

A cam roller 44 is mounted to a cam follower block 46. The roller 44 includes a central passage 48 for receiving a shaft, as will be described below. The roller 44 is configured for engagement with a cam lobe or surface (not shown) to urge the roller 44 and follower block 46 toward or into the cavity 36. The follower block 46 has a piston-like shape and is configured for mounting within the gripper body 30.

The follower block 46 has a generally flat base 50 and a depending roller support portion 52 that is essentially formed as a pair of legs that depend from the base 50. The legs 52*a,b* each include a pin opening 54 therein. The follower block 46 includes a projection 56 extending outwardly therefrom that traverses within a channel 58 formed in the wall of the body 30.

A single stack (or set) of springs 60 is positioned in the body 30, on the follower block base 50. In this manner, the springs 60 are captured between the follower block 46 and the inner wall of the body (within the cavity 36). In a present embodiment, a single set of two concentric springs 60*a,b* is used to bias the gripper body 30 (relative to the roller 44 and follower block 46).

The assembly 14 is secured by a single retaining element 62. In a present embodiment, the retaining element is a pin 62. The pin 62 is positioned through the body pin openings 40, through the follower block pin openings 54 and through the roller passage 48. Thus, the pin 62 serves as the rotational axis for the roller 44, as well as to maintain the gripper 14 as an assembly. In this manner, the present gripper 14, which includes a single spring set 60*a,b* and a single pin 62, is significantly smaller and lighter than known grippers and is mechanically a less complex assembly (due a lesser number of parts).

As set forth above, the body openings 40 (for receiving the pin 62) are elongated or notched (in the direction indicated at 42). This permits a small amount of reciprocating movement of the follower block 46 and roller 44 within and relative to the body 30. This assures that an appropriate force is exerted by the grip pad 32 on the strap, and further assures good contact and holding of and by the grip pad 32 on the strap, even when taking in to consideration the tolerances for strap thickness.

All patents referred to herein, are incorporated by reference, whether or not specifically done so within the text of this disclosure.

In the present disclosure, the words "a" or "an" are, where appropriate, to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A gripper assembly for a strapping head for a strapping machine, comprising:

a body defining a cavity therein and having an end wall, the body having a gripping pad on an exterior portion thereof, the body further including opposing walls and having openings formed in the opposing walls;

a spring stack disposed in the cavity, an end of the spring stack abutting the end wall of the body;

a follower block positioned in the cavity, the follower block having a base and a roller support portion, the roller support portion having openings therein;

a roller positioned in the roller support portion, the roller having a passage therethrough; and a single retaining element disposed through the body openings, the follower block openings and the roller passage, the retaining element disposed to maintain the follower block within the body with the roller secured thereto and to maintain the spring stack captured within the body cavity.

2. The gripper assembly in accordance with claim 1 wherein the single retaining element is a pin.

3. A gripper assembly for a strapping head for a strapping machine, comprising:

a body defining a cavity therein and having an end wall, the body having a gripping pad on an exterior portion thereof, the body further including opposing walls and having openings formed in the opposing walls;

a spring stack disposed in the cavity, an end of the spring stack abutting the end wall of the body;

a follower block positioned in the cavity, the follower block having a base and a roller support portion, the roller support portion having openings therein;

a roller positioned in the roller support portion, the roller having a passage therethrough; and a retaining element disposed through the body openings, the follower block openings and the roller passage, the retaining element disposed to maintain the follower block within the body with the roller secured thereto and to maintain the spring stack captured within the body cavity, wherein the body openings are formed as elongated openings elongated in a longitudinal direction, and wherein the roller and follower block are longitudinally movable relative to the body to compress and expand the spring stack.

4. The gripper assembly in accordance with claim 1 including a single spring stack.

5. The gripper assembly in accordance with claim 1 wherein the spring stack is formed from more than one spring.

6. The gripper assembly in accordance with claim 5 wherein the spring stack is formed from two concentrically disposed springs.

7. The gripper assembly in accordance with claim 1 wherein the body has a generally rectangular cross-section.

* * * * *